United States Patent [19]

Bouquet

[11] 3,963,008

[45] June 15, 1976

[54] METHOD OF REMOVING A VALVE MOUNTED IN AN INTERNAL COMBUSTION ENGINE CYLINDER-HEAD AND ACTUATING DEVICE FOR CARRYING OUT THE SAID METHOD

[75] Inventor: Jean-Claude Bouquet, Pantin, France

[73] Assignee: Societe d'Etudes de Machines Thermiques, Saint Denis, France

[22] Filed: Oct. 8, 1974

[21] Appl. No.: 513,071

[30] Foreign Application Priority Data

Nov. 9, 1973 France ..... 73.39989

[52] U.S. Cl. ..... 123/90.61; 123/90.62; 123/90.63

[51] Int. Cl.[2] ..... F01L 1/14

[58] Field of Search..... 123/90.61, 90.62, 90.63, 123/90.64, 90.47, 90.39

[56] References Cited

UNITED STATES PATENTS

| | | | |
|---|---|---|---|
| 1,624,497 | 4/1927 | McAllister | 123/90.63 |
| 1,927,020 | 9/1933 | Brown | 123/90.62 |
| 2,346,737 | 4/1944 | Essl | 123/90.61 |
| 2,749,891 | 6/1956 | Russell | 123/90.62 |
| 3,038,459 | 6/1962 | Schmid | 123/90.61 |
| 3,048,156 | 8/1962 | Van Slooten | 123/90.61 |
| 3,699,934 | 10/1972 | Gaipo | 123/90.61 |

*Primary Examiner*—Charles J. Myhre
*Assistant Examiner*—Daniel J. O'Connor
*Attorney, Agent, or Firm*—Kenyon & Kenyon Reilly Carr & Chapin

[57] ABSTRACT

Method for removing a valve mounted in an internal combustion engine cylinder-head, and valve actuating device allowing to carry out said method which comprises the steps of increasing the clearance between the valve rod and the corresponding end of its rocker arm, shifting laterally the corresponding push-rod for allowing the end of the rocker arm to be withdrawn from the removal path of the valve, and removing the valve upwardly.

4 Claims, 2 Drawing Figures

METHOD OF REMOVING A VALVE MOUNTED IN AN INTERNAL COMBUSTION ENGINE CYLINDER-HEAD AND ACTUATING DEVICE FOR CARRYING OUT THE SAID METHOD

The present invention has essentially for its object a method of removing a valve mounted in an internal combustion engine cylinder-head and moved by a rocker arm by means of a push-rod actuated by a camshaft, and a valve actuating device for carrying out the said method.

The replacement of an overhead valve hitherto required that the whole rocker assembly be removed, reinstalled and then readjusted, and all this took a rather long time.

The present invention allows such operations to be avoided by using a method consisting essentially in increasing the clearance between the valve stem and the valve-side end of the rocker arm, by unscrewing each clearance adjusting set screw if appropriate, in shifting the push-rod laterally so as to allow the opposite end of the rocker arm to be lowered by rotating the rocker arm until the drive end of the rocker arm is withdrawn from the valve removal path, and in removing the valve upwardly.

The valve actuating device for carrying out the said method is of the type in which the push-rod passes through a wall of the crankcase or of the said cylinder head through an orifice in the latter, and is characterized in that the said orifice is sufficiently large with respect to the transverse dimension of the push-rod to enable the latter to be shifted laterally in the said orifice sufficiently to allow the upper end of the push-rod to be withdrawn from below the adjacent driven end of the rocker arm.

The said device may also comprise selectively releasable locking means intended to maintain the push-rod under the adjacent actuating end of the rocker arm.

Other features and advantages of the invention will appear more clearly from the following description made with reference to the appended drawings illustrating one form of embodiment of the device according to the invention wherein.

Figure 1:
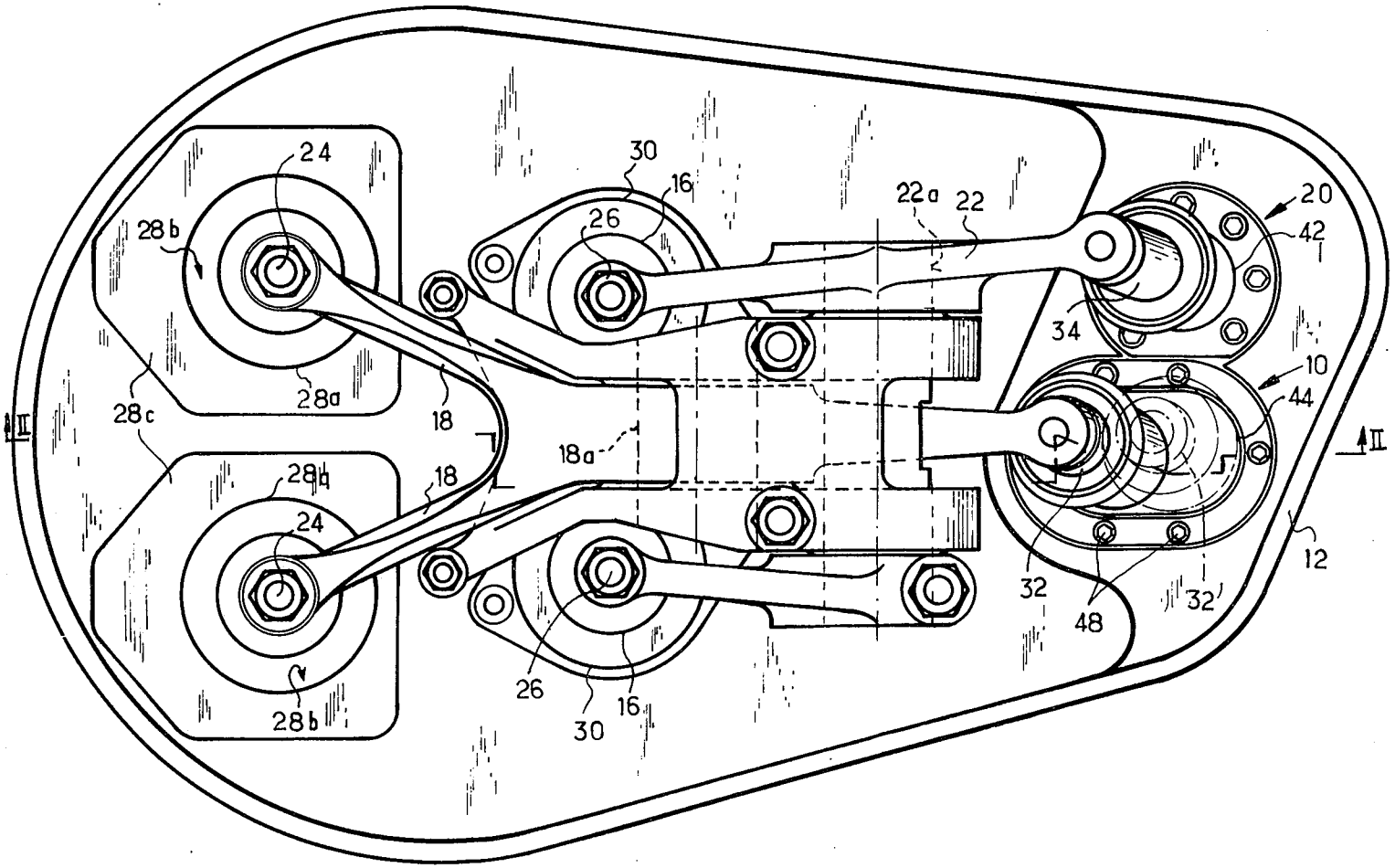
FIG. 1 is a top view of an internal combustion engine cylinder-head incorporating a valve actuating device according to the present invention.
Figure 2:
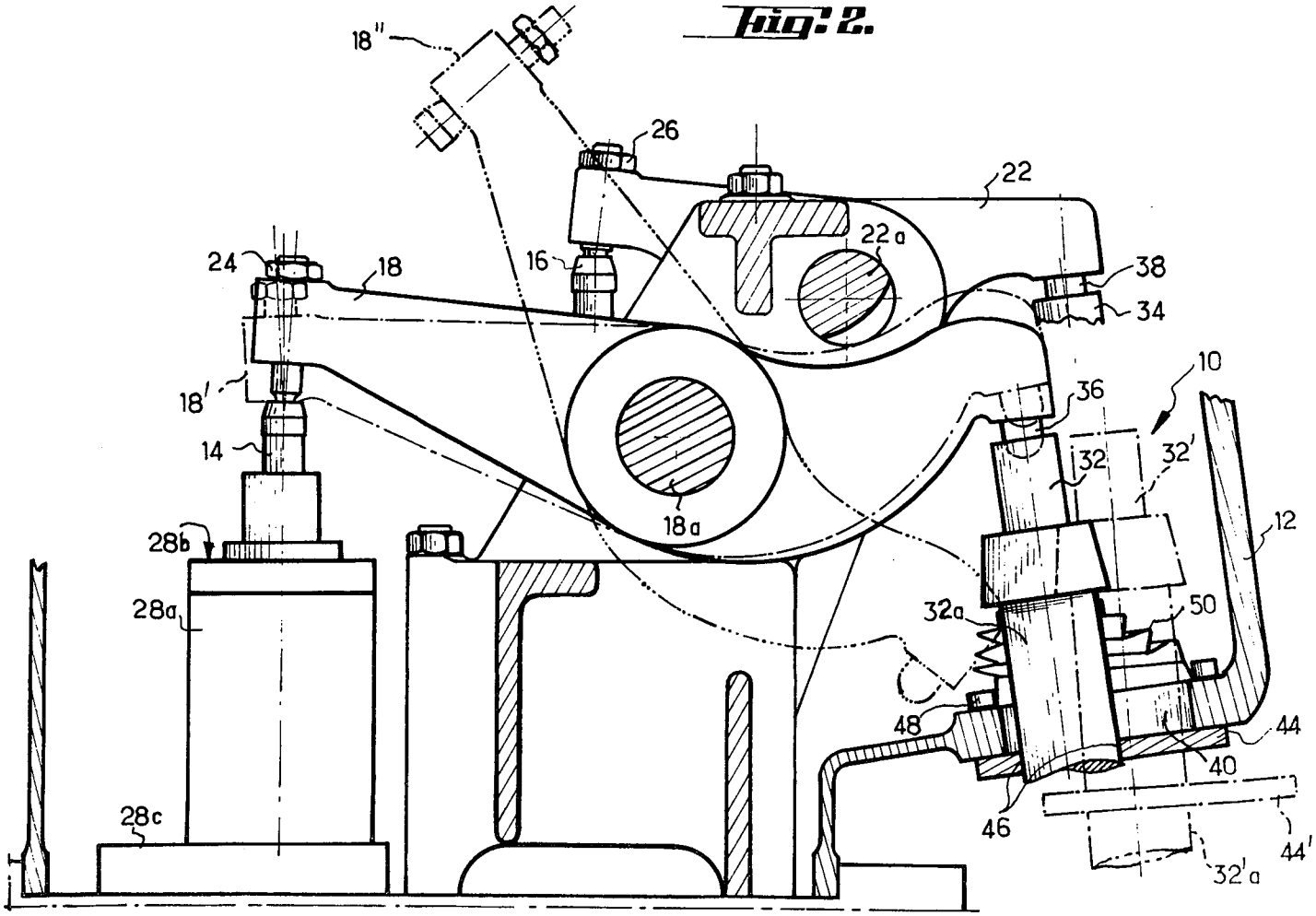
FIG. 2 is a sectional view taken upon the line II—II of the engine portion shown in FIG. 1.

FIGS. 1 and 2 illustrate a valve actuating device 10 according to the invention, mounted on the crankcase 12 of an internal combustion engine comprising two exhaust valves 14 and two inlet valves 16, all of which are mounted in the engine cylinder head. In the exemplary embodiment illustrated, the device 10 actuates the exhaust valves 14 through the medium of an exhaust valve rocker-arm 18 swinging about a shaft 18*a*, whereas both inlet valves 16 are actuated by an actuating device 20 of a conventional type actuating an inlet valve rocker arm 22 swinging about a shaft 22*a*. The position assumed by the exhaust rocker arm 18 for normal operation of the engine is the one shown in solid continuous lines in FIG. 2.

The illustrated valves are of the mushroom type, the upper stem ends of which are actuated through clearance adjusting set screws 24, 26, respectively, mounted on the corresponding ends of the respective rocker arms 18 and 22. The maximum radial size of the valve springs is shown by the outlines 28*a* for the exhaust valves and 30 for the inlet valves. In order to replace a valve, the mechanism comprising the locking socket 28*b*, the spring 28*a* and the body 28*c* must be removed at the same time as the valve.

Both actuating devices 10 and 20 comprise respectively two push-rods 32 and 34, the upper ends of which are provided each one with an axial recess receiving the corresponding ends of the respective rocker arms which are provided in this same region with push-pins 36, 38 projecting from the rocker arms along the center-lines of the push-rods, respectively. The push-rods 32 and 34 serving to transmit to the rocker arms the motion imparted to them by tappets actuated by a camshaft located in the lower portion of the engine (not shown), pass through respective orifices 40, 42 provided in the wall of the crankcase 12.

In the actuating device 20 of a conventional type such as shown in FIG. 1, the orifice 42 has a circular section in coaxial relation to the push-rod 34 and is slightly greater in diameter than the said rod.

In contradistinction to this, the valve actuating device 10 according to the invention is characterized, in the examplary embodiment illustrated, by the fact that its orifice 40 is oblong in a direction normal to the axis of swing 18*a* of the exhaust valve rocker-arm 18. Selectively releasable locking means are provided to maintain the protection tube 34*a* of the exhaust valve push-rod 32 under the push-pin 36 of the exhaust valve rocker-arm and are represented in the drawings by a plate 44 provided with a circular hole 46 which is slightly greater in diameter than the tube 32 and secured to the wall of the crankcase 12 by means of screws (not shown). Furthermore, the device 10 may include, as shown in FIG. 2, an external protection means covering the oblong orifice 40 and constituted in this instance by a supple bellows 50 surrounding an external portion of the push-rod and secured to the crankcase wall around the orifice by screws 48.

The method of removing an exhaust valve by means of the valve actuating device 10 just described will now be described with reference to FIG. 2.

The position in the working state of the exhaust rocker arm 18 being as shown by solid lines in FIG. 2 and the valve being closed, the removal of a valve 14 together with its associated mechanism 28*a,b,c* consists in first increasing the clearance between the valve stem 14 and the drive end of the rocker arm 18 by unscrewing each clearance adjusting set screw 24 until the rocker arm 18 is sufficiently tilted to allow the push-pin 36 to be disengaged from the push-rod 32 as illustrated in the position 18' of the rocker arm shown in dash-dotted lines. The push-rod 32 and the tube 32*a* are then shifted laterally by unscrewing the plate 44 (positions 32', 32'*a* and 44' shown in dash-dotted lines) in order that the driven end of the rocker arm may be lowered by rotating the rocker arm 18 until it reaches the position 18'' shown in dash-dotted lines, thus withdrawing the valve-side end of the rocker arm from the removal way of the valve 14. The process ends with the removal of the valve upwardly.

The same operations are carried out in the reverse sequence in order to reinstall the valve.

As it generally follows from the method described, it is sufficient that the orifice 40 be sufficiently large with respect to the transverse dimension of the push-rod 32 and the tube 32*a* to enable the latter to be sufficiently shifted laterally in the orifice to allow the upper end of the push-rod to be withdrawn from under the adjacent driven end of the rocker arm carrying the push-pin 36. Therefore, the oblong orifice 40 as illustrated is only a particular examplary embodiment of the invention.

Of course, the invention is by no means limited to the form of embodiment described and illustrated, which has been given by way of example only. In particular, it comprises all the means constituting technical equivalents of the means described as well as their combinations, should the latter be carried out according to the gist of the invention.

What is claimed is:

1. In an internal combustion engine including: at least one cylinder head; at least one overhead poppet valve mounted in said cylinder head; a rocker-arm swingingly mounted on said cylinder head and having a drive end freely engaging in releasable relationship the top end of the valve stem and an opposite driven end; and a reciprocable push-rod means enclosed within and projecting upwards from a tubular housing forming a standpipe means, said push-rod means co-operating through its top end in freely fitting and disconnectable relationship with said driven end of said rocker-arm, said push-rod means and stand-pipe assembly means extending upwards with clearance through an opening means formed in said cylinder head; and locking means covering said opening means and removably secured to said cylinder head in engaging relationship with said standpipe means to hold same against motion and keep it in substantially registering relation to said driven end of said rocker-arm, the improvement consisting in that said valve is removable upwards from said cylinder head; said drive end of said rocker-arm is provided with an axially adjustable set screw means through the bottom end of which said drive end engages said valve stem, whereas said screw means is, by being unscrewed, retractable upwards relative to said rocker-arm to an extent allowing said driven end of the latter to be disengaged from said push-rod upon tilting said rocker-arm towards said valve; said push-rod means and stand-pipe assembly means being displaceable sidewise in an unconstrained condition; said opening means is of elongated shape for providing said clearance which is large enough for enabling said push-rod means and standpipe means assembly, upon retracting said set screw means, tilting said rocker arm and releasing said locking means, to be shifted sidewise away from below said driven end of said rocker-arm so as to clear the path of travel thereof, whereby said drive end of said rocker-arm may, through reverse tilting of the latter, be moved out of the removal way of said valve.

2. An arrangement according to claim 1, wherein said locking means is a retaining plate formed with a through-hole through which said stand-pipe means extends in snugly slidable relationship.

3. An arrangement according to claim 2, wherein said opening means is formed in a web-like wall portion of said cylinder head and said retaining plate is mounted on and adapted to be secured to that side of said wall portion which is opposite and facing away from said rocker-arm.

4. An arrangement according to claim 3, comprising a flexible bellows on the opposite side of said wall portion with respect to said retaining plate and tightly surrounding an upper projecting portion of said standpipe means, said bellows being detachably secured in sealing relationship to said wall portion about said opening.

* * * * *